US010188921B2

(12) United States Patent
Kleinfeld et al.

(10) Patent No.: US 10,188,921 B2
(45) Date of Patent: Jan. 29, 2019

(54) MULTIPLE SPORT TRAINING DEVICE AND SPORT TRAINING SYSTEM

(71) Applicant: Flip Goalie, LLC, Hampstead, MD (US)

(72) Inventors: Terry Scot Kleinfeld, Hampstead, MD (US); Brian Jeffrey Rudick, Sparks, MD (US)

( * ) Notice: Subject to any disclaimer, the term of this patent is extended or adjusted under 35 U.S.C. 154(b) by 0 days.

(21) Appl. No.: 15/085,447

(22) Filed: Mar. 30, 2016

(65) Prior Publication Data

US 2016/0287960 A1 Oct. 6, 2016

Related U.S. Application Data

(60) Provisional application No. 62/140,266, filed on Mar. 30, 2015.

(51) Int. Cl.

| | |
|---|---|
| ***A63B 63/00*** | (2006.01) |
| ***A63B 61/00*** | (2006.01) |
| ***A63B 69/00*** | (2006.01) |
| *A63B 102/14* | (2015.01) |
| *A63B 71/02* | (2006.01) |

(52) U.S. Cl.

CPC ..... *A63B 63/004* (2013.01); *A63B 69/0097* (2013.01); *A63B 69/002* (2013.01); *A63B 69/0024* (2013.01); *A63B 2063/001* (2013.01); *A63B 2063/002* (2013.01); *A63B 2071/026* (2013.01); *A63B 2102/14* (2015.10); *A63B 2210/50* (2013.01); *A63B 2225/09* (2013.01); *A63B 2225/093* (2013.01)

(58) Field of Classification Search

CPC ..... A63B 63/004; A63B 69/0097; A63B 2102/14; A63B 69/002; A63B 69/0024; A63B 2063/001; A63B 2063/002; A63B 2071/026; A63B 2210/50; A63B 2225/09; A63B 2225/093

USPC ..... 473/446, 422, 434, 435, 439, 454, 456, 473/471, 197; 273/410, 401

See application file for complete search history.

(56) References Cited

U.S. PATENT DOCUMENTS

| | | | | | |
|---|---|---|---|---|---|
| 3,820,787 | A * | 6/1974 | Heinbigner | A63B 63/00 | 473/439 |
| 4,160,549 | A * | 7/1979 | Simpson | A63B 61/006 | 473/462 |
| 4,275,883 | A * | 6/1981 | Grimaldi | A63B 47/025 | 473/432 |
| 4,948,147 | A * | 8/1990 | Pallanca | A63B 63/00 | 473/478 |
| 5,181,725 | A * | 1/1993 | Leras | A63B 63/004 | 473/446 |
| 5,271,616 | A * | 12/1993 | Grimaldi | A63B 63/00 | 473/432 |
| 5,271,624 | A * | 12/1993 | Sciortino | A63B 63/004 | 473/446 |

(Continued)

*Primary Examiner* — Mitra Aryanpour

(57) ABSTRACT

In one embodiment, the multi-sport training device disclosed herein comprises a plurality of adjustable panels that easily attach to a frame of a goal and may be adjusted to different configurations desired by the player, or shooter. Each panel in the plurality of panels is configured for independent attachment to the goal, and may be hung vertically from the crossbar of the goal, or "flipped" over the goal to expose a portion of the open goal. Each panel is also configured for independent adjustment in length.

9 Claims, 5 Drawing Sheets

(56) References Cited

U.S. PATENT DOCUMENTS

| | | | | | |
|---|---|---|---|---|---|
| 5,338,044 | A * | 8/1994 | Mazursky | A63B 63/083 | 473/447 |
| 5,413,533 | A * | 5/1995 | Bolus | A63D 5/00 | 473/55 |
| 5,863,266 | A * | 1/1999 | Starnes | A63B 24/0021 | 473/471 |
| 6,189,889 | B1 * | 2/2001 | Yip | A63B 63/00 | 473/460 |
| 6,264,572 | B1 * | 7/2001 | Matheson | A63B 69/0026 | 473/446 |
| 7,651,416 | B2 * | 1/2010 | Farquhar | A63B 63/004 | 473/446 |
| 8,113,968 | B2 * | 2/2012 | Fittler | A63B 63/003 | 473/422 |
| 8,246,494 | B2 * | 8/2012 | Stephenson | A63B 63/004 | 473/422 |
| 9,028,346 | B2 * | 5/2015 | Melin | A63B 63/003 | 473/446 |
| 2009/0258735 | A1 * | 10/2009 | Nash | A63B 63/004 | 473/478 |
| 2016/0213988 | A1 * | 7/2016 | Yang | A63B 63/004 | 473/478 |
| 2016/0287960 | A1 * | 10/2016 | Kleinfeld | A63B 63/004 | 473/446 |

* cited by examiner

G1 = Top edge grommets (3)
G2 = 2nd row grommets (3)
G3 = 3rd row grommets (3)
G4 = Bottom edge grommets (3)

MULTIPLE SPORT TRAINING DEVICE AND SPORT TRAINING SYSTEM

CROSS REFERENCE TO RELATED APPLICATIONS

The present application claims priority from U.S. Provisional Application Ser. No. 62/140,266 filed on Mar. 30, 2015, the contents of which are hereby incorporated by reference in their entirety.

BACKGROUND OF THE INVENTION

Current training systems for sports such as lacrosse, field hockey, or soccer are static sheets that attach and cover the complete goal except for a few holes in the material. The present devices are very difficult to use because the holes in the material are hard to shoot through. In addition, these devices must be removed from the goal in order to use the goal as a goal. These devices are not practical in that they take a long time to attach and take down.

It is highly desirable for a training device and system to be easily transportable, as most training systems are bulky, difficult to transport or time consuming to assemble.

SUMMARY OF THE INVENTION

In one embodiment, a multi-sport training device and system is disclosed that is adjustable, transportable, lightweight, and provides multiple configurations.

It is an advantage of the present invention to provide a system for use with a standard lacrosse goal—or any other sport goal—for returning balls shot into the goal.

It is another advantage of the present invention to provide a system for use with a lacrosse goal or any other sport goal that is easily transportable.

It is another advantage of the present invention to provide a system for use with a lacrosse goal or any other sport goal that is easily attached (coupled) or de-attached (uncoupled) from the goal.

In accordance with the above advantages of the present invention, a training system is provided. The training system includes a plurality of panels configured for reversible attachment to a horizontal section of a frame, that upon attachment to the frame hang vertically from the frame.

The frame may include two or three sides coupled together. Coupled to one corner of the frame is at least one stand portion extending at an angle thereto, such that, when the frame is placed on a flat surface, the corner has a higher elevation than the other two corners to allow a ball to be deflected outwardly from the goal. All of the stand portions may be extendable for varying the angle of the corner relative to the flat surface. The ball returner may or may not be physically coupled (i.e. attached) to the sports goal and is lightweight and transportable.

In one embodiment, a multi-sport training system, comprises a rectangular frame, wherein the frame is configured with a horizontal crossbar coupled to a pair of upright side members aligned perpendicular to the crossbar, and frames an open goal area; a plurality of panels, each panel configured with a length adjustment system and attachment means for reversibly securing the panel to the crossbar of the frame in a manner that permits 360 degree movement of the panel around the crossbar; and wherein one or more of the plurality of panels are attached to the frame so that the one or more panels hang vertically from the crossbar, the panels arranged side-by-side in a plane, and wherein the panels are adjusted in length to control the coverage of the open goal area to create a target goal area, thereby facilitating a user in shooting practice to direct a ball at the targeted goal area. In one embodiment, the crossbar and/or the upright side members are adjustable in length. In another embodiment, the frame dimensions comprising a crossbar ranging in length from 4 feet to 7 feet, and upright side members ranging in length from 4 feet to 7 feet.

In another embodiment, a multi-sport training device comprises a panel configured with a top end, and bottom end, a front side and a back side; attachment means at the top end for reversible attachment of the panel to a stationary member, thereby permitting the panel to hang vertically when attached thereto; one or more weighted features; and adjustment means for adjusting the length of the panel, wherein adjustment means comprise a series of openings aligned in one or more horizontal rows along the panel, the rows spaced apart from each other, and one or more securement members attached to the bottom end of the panel for securement with an opening by aligning a securement member through the opening from either the front or back side of the panel to the opposing back or front side of the panel.

In one embodiment, the panel is of a length ranging from 60 to 80 inches in length, and preferably between 68 and 74 inches in length. In another embodiment, the panel is of a width ranging from 18 to 30 inches, and preferably between 20 to 23 inches.

In one embodiment, the panel is comprised of natural or synthetic materials, or a combination thereof, and may be of a single layer or multiple layers and the panel is of a tensile strength to withstand the force of sport balls propelled at the panel at a high rate of speed without breaking.

In one embodiment, the adjustment system comprises one or more rows of grommets, and one or more toggles attached to the bottom of the panel, with a toggle length greater than the grommet opening, but a toggle width narrow enough to slide into the opening of the grommet and traverse the panel.

These and other features and advantages of the present invention will become apparent from the following detailed description of the preferred embodiments, when viewed in accordance with the accompanying drawings and appended claims.

DETAILED DESCRIPTION OF THE PREFERRED EMBODIMENT

Figure 1:
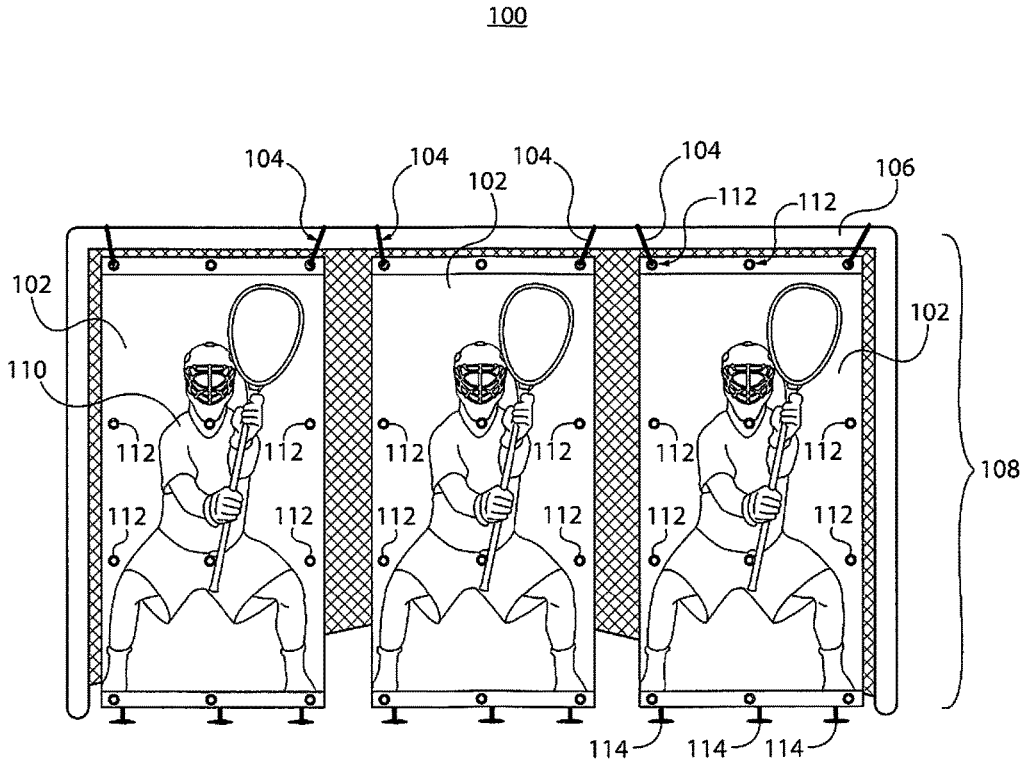
FIG. 1 is a front view of a multi-sport training system showing full extension of a plurality of panels, according to one embodiment of the present invention.

It is one aspect of the present invention to provide a multi-sport training device and system to aid athletes in the improvement of their shooting skills, such as lacrosse players.

In one embodiment, the multi-sport training device disclosed herein comprises a plurality of adjustable panels that easily attach to a frame of a goal and may be adjusted to different configurations desired by the player, or shooter. Each panel in the plurality of panels is configured for independent attachment to the goal, and may be hung vertically from the crossbar of the goal, or "flipped" over the goal to expose a portion of the open goal. Each panel is also configured for independent adjustment in length.

In one embodiment, the panels are adjustable for use during practice for shooting drills, or as a stand-in for a goalie. When not in use, the panels may be flipped over the crossbar of the goal or may be rolled upward and secured at the crossbar, thereby unimpeded access to the goal area is provided.

Exemplary Panel

In one embodiment a multi-sport training device comprises a panel, wherein the panel is rectangular in shape, with a top end, a bottom end, a front side and a back side. In one embodiment, the panel has an overall length of approximately 70-72 inches. In another embodiment, the panel has an overall width of approximately 22-25 inches. The panel may be made of synthetic materials such as nylon, or other suitable durable materials that withstand the force of a ball propelled at the panel. Examples of suitable materials include, but are not limited to thin fabric, e.g., reinforced vinyl, which is durable and lightweight, Teflon fabrics, tightly woven canvas, or combinations thereof.

In one embodiment, the front side of the panel has an image printed or adhered to the surface thereto, such as an image of a goalie (the image may approximate life size), which facilitates the training aspects of the invention. The image, while optional, allows a trainee/player to practice shooting skills by aiming for spots where goalies can't easily make the save, such as over the shoulder, under the arm, or on the goalie's weak side.

In one embodiment, the panel is configured with a weighting feature comprising one or more weighting elements for wind resistance. In one embodiment, weighting elements comprises sand, water, dirt, gravel, rocks, cement, a length of a metal rod, pole or bar, or one or more metal balls (metal includes, but is not limited to, titanium, steel, aluminum, brass, copper, tin, and the like), a length of a wooden poles and/or pvc poles. In another embedment, weighting is provided in a range of 2 ounces to 2 pounds; preferably 2 ounces to 20 ounces; although this example is illustrative and not intended to be limiting. The weighting feature comprises a pocket or other storage compartment that may be sewn into the panel or removably attached to the panel by snaps, Velcro, tape, buttons, zippers, or other fastening means.

In one particular embodiment, a bottom edge of the panel is configured with a sealed pocket on each side of a center grommet, the center grommet located at approximately the center point along the bottom edge of the grommet. In one embodiment, each pocket contains a weighted component, such as an eight-inch long weighted component, one to the left side of the center grommet and one to the right side of the center grommet, the pockets formed on the back side of the panel, although the pockets may also be positioned on the front side of the panel, or both the front side and the back side of the panel. While the weighting has been described in relation to a bottom edge grommet, it should be understood that in the absence of a grommet, the weighted component may be placed along the bottom edge of the panel, either continuously or sectioned. In one embodiment, the right side weighted component is in a range of 2-10 ounces in weight, preferably 6-8 ounces. In another embodiment, a weighting feature may be inserted into a seam or channel, the seam or channel formed from a panel comprising a double layer of material. In one embodiment, a length of panel at the edge is folded back on itself, the edge of the panel is attached to the panel as if hemming the panel—leaving a partially-open channel formed by the two layers of panel material. In one embodiment, the panel channel has a width ranging from 1 inch to 4 inches, and can vary depending on the weighting feature intended for the channel. For example, if using a plastic or wooden rod to weight the panel, the opening would accommodate the dimensions of the rod.

In another embodiment, a toggle is positioned along the bottom edge of the panel, and may be located to the left or right of the grommets (center grommet, right side grommet, and left side grommet).

In one embodiment, the top end of the panel is configured with attachment means for securing to the panel to the crossbar of a goal frame. In one embodiment, the attachment means comprise a bungee connect cord, rope, clips, elastic bands, Velcro, snaps, string, heavy duty rubber bands, toggles, or other suitable attachment means. In another embodiment, attachment means are secured to the panel via grommets placed along the top of the panel near the top edge. In one embodiment, a plurality of No. 4 grommets are positioned along the top end of the panel, for example, approximately one-half inch from the panel edge. In one particular embodiment, the top end of the panel is configured with three grommets; a center grommet located approximately 12 inches from an outer edge, a left and right grommet on either side of the center grommet positioned approximately 10 inches from the center grommet, the grommets positioned in a horizontal row.

In one embodiment, the panel is configured to be adjustable in length. In one embodiment, the panel is configured with one or more rows of grommets, a row comprising two or more grommets horizontally aligned and spaced a distance apart from each other in alignment with a row above and/or beneath the row. For example, a panel may be configured with four rows of horizontally aligned grommets; a first row along a top end of the panel, a second row spaced approximately 20-24 inches below the first row, and a third row spaced approximately 20-24 inches from the second row. A fourth row may be positioned along a bottom end of the panel. In another embodiment, the panel may be configured with additional rows, or with less rows, as desired for adjustment of the panel.

In one embodiment, the length of the panel is adjusted by folding the panel back, aligning the toggles with the grommet of a row upward toward the top end of the panel, and placing the toggle through the grommet opening to secure the panel in the adjusted position.

Exemplary Training System

In one embodiment, a multi-sport training system comprises a plurality of panels configured for reversible attachment to a frame, wherein the panels comprise an adjustment system for adjusting the length of the panel, wherein the adjustment system comprises one or more adjustments means comprising rows of openings aligned horizontally along a portion of the panel, and securement means for securing the panel at an adjusted length. In one embodiment, the length of the panel is adjusted by folding the panel upward, along the front or the back of the panel and aligning securement means to the adjustment means, thereby securing the panel at the adjusted length. In one particular embodiment, adjustment means comprise one or more rows of grommets aligned horizontally on the panel. In another embodiment, securement means comprise one or more toggles attached to the bottom end of the panel, for placements through the grommets on the panel.

In one embodiment, the frame of the system comprises a crossbar and sidebars, and optional base. In one embodiment, the frame is commensurate in size with a standard lacrosse goal, however, other sizes are envisioned. For example, a standard goal area is generally 6 feet by 6 feet, however, the system is compatible and adaptable to essentially any goal types by adjusting the number of panels used to cover the goal opening, together with an adjustment in the length of the panels if needed.

In one embodiment, a goal frame comprises two side members aligned essentially vertical to the ground, which may or may not be adjustable, with an end of each of the vertical side members coupled to a horizontal crossbar, the horizontal crossbar aligned essentially parallel to the ground. In one embodiment, the goal frame comprises a net attached to the goal frame. One or more cantilever members may be coupled to the frame, such as to each vertical side member in order to stabilize the frame and keep the frame in a stable position on the ground. In another embodiment, the front of the goal comprises a goal entrance size corresponding to that of the sport or game for which the goal assembly is intended.

Turning now to the figures, which show various embodiments of the present invention. FIG. 1 shows a multi-sport training system 100 comprising a plurality of panels 102, wherein the panels are configured with attachment means 104 at a top end of panel 102. Attachment means 104 secure the panel for reversible attachment to a horizontal crossbar 106 of frame 108, thereby permitting panels 102 to hang vertically from the crossbar. FIG. 1 shows system 100 comprising three panels 102 secured to crossbar 106 of frame 108, the panels fully extended and comprising an image 110 displayed on the front side of the panel. Panels 102 are configured with an adjustment system comprising adjustment means and securement means, the adjustment means shown as one or more rows of grommets 112, which are aligned horizontally and spaced vertically from another row of grommets, so that the individual grommets align vertically and horizontally along the panel, and wherein securement means are shown as toggles 114 attached to the base of the panel (shown in FIG. 1 as three toggles) for engagement with the grommets 112.

Figure 2:
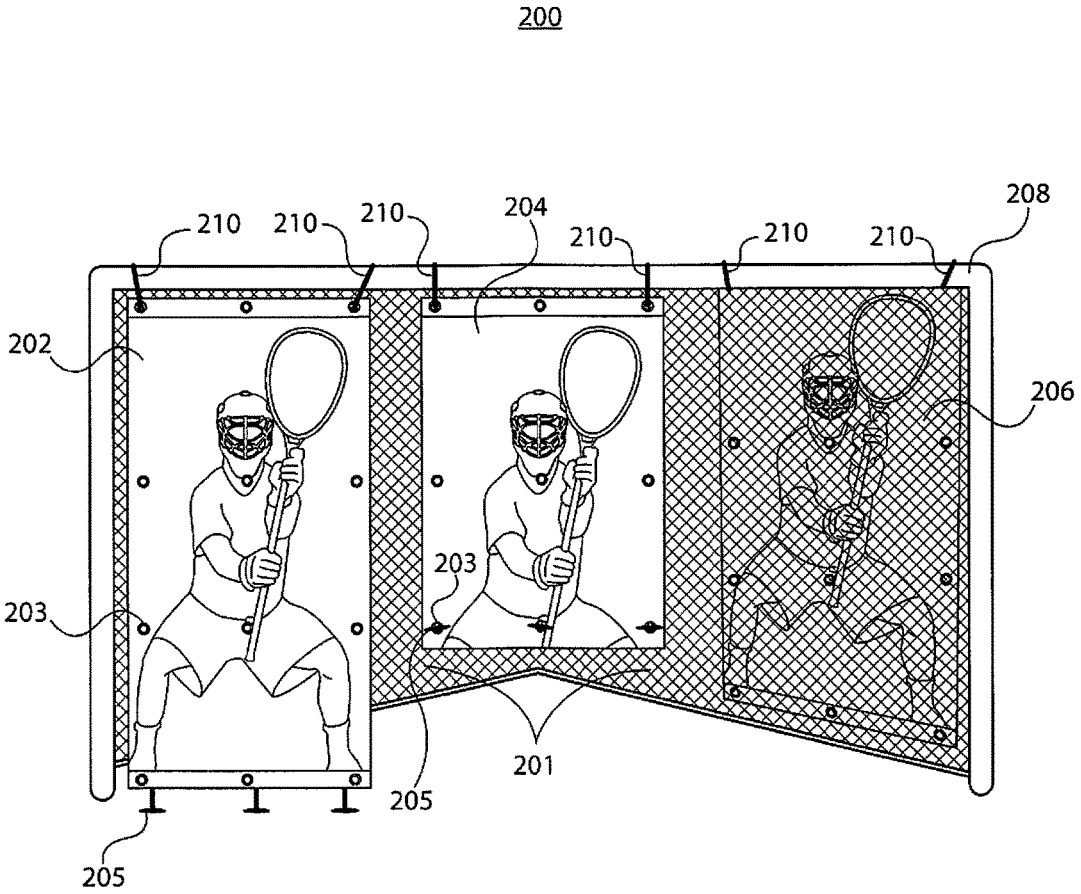
FIG. 2 is a front view of a multi-sport training system showing panels in various orientations, including fully extended and partially adjusted, according to one embodiment of the present invention.

FIG. 2 shows a partially-adjusted multi-sport training system 200 comprising a side panel 202 covering the left third of a goal area 201, a center panel 204 covering a center third of the goal area, and a second side panel 206 shown "flipped" around to the back-side of a goal frame 208 to expose the right third of the goal area. Each panel is reversibly attached to goal frame 208 by attachment means 210 and configured with grommets 203 and toggles 205, whereby upon engagement of a toggle with a grommet, such as by placing the toggle in the opening of the grommet, with the toggle traversing the panel opening to protrude through the opposite side of the panel, and positioned so the end of the toggle extends beyond the edges of the grommet on the opposite side of the panel (illustrated by way of center panel 204), so that the toggle remains engaged with the grommet, thereby providing for an adjusted length of the panel.

Figure 3:
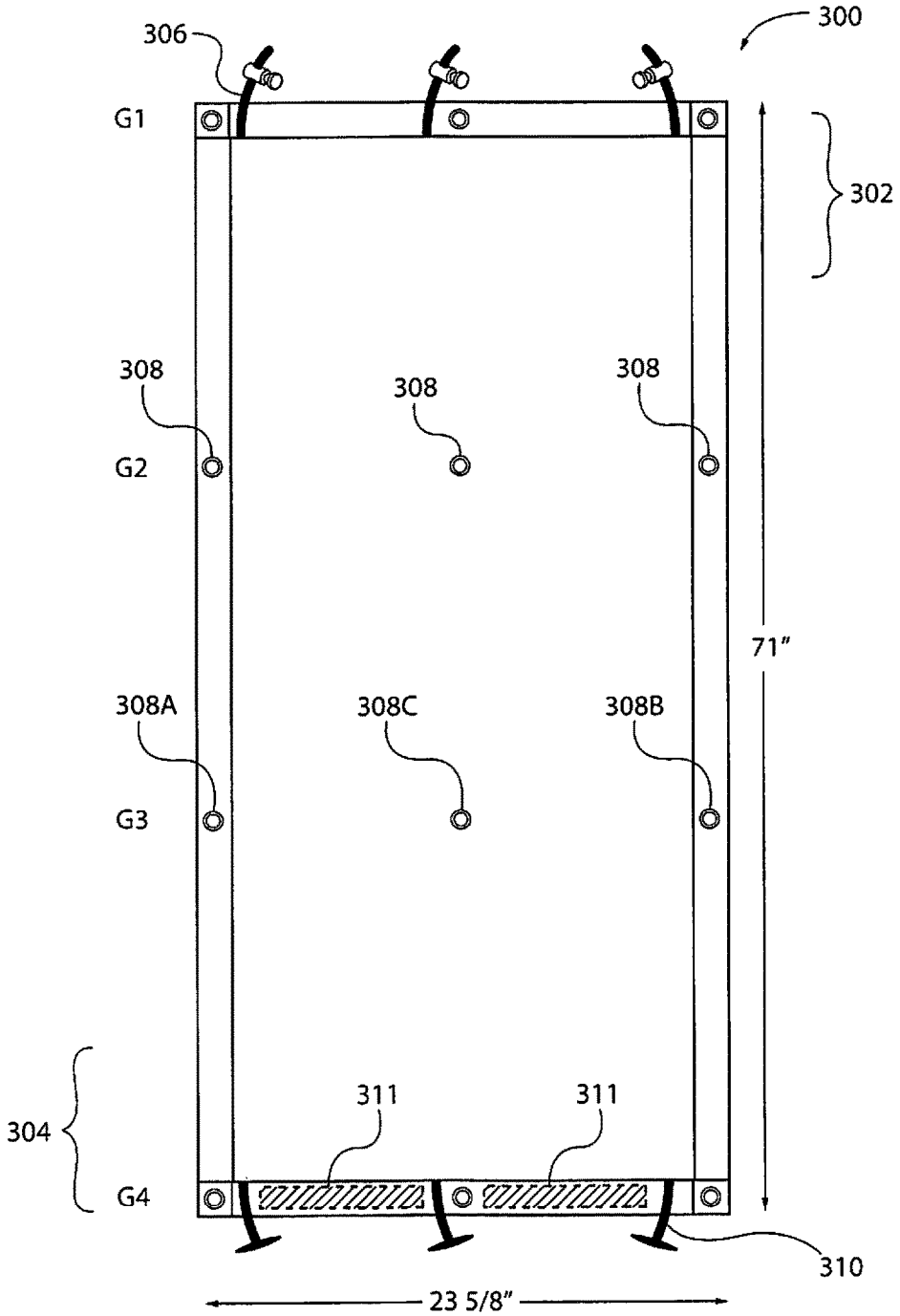
FIG. 3 is a back view of a training device panel—shown fully extended, according to one embodiment of the present invention.

FIG. 3 shows a rear view of an exemplary training device 300 according to one embodiment of the invention. Panel 300 is rectangular in shape with a top portion 302 and a bottom portion 304. Attachment means 306 are positioned at the top end 302 of panel for securing the panel around a frame or other suitable stationary member that allows the panel—when attached—to hang vertically when fully extended. Panel 300 comprises a panel adjustment mechanism comprising adjustment means, here shown as a plurality of openings aligned horizontally and vertically, the openings comprising grommets 308, and securement means 310 positioned at the bottom end 304 of panel 300. Grommets 308 are shown in the figure as four rows comprised of 3 grommets each: G1, G2, G3, and G4, with a center grommet (shown in G3 as 308C) and two side grommets (shown in G3 as 308A and 308B). The overall length of panel 300 is shown as approximately 71 inches; and width is shown as approximately 23-24 inches, which is illustrative and not meant to be exhaustive of panel dimensions. Also shown in FIG. 3 is weighting feature 311, shown as two pockets formed as part of the panel hem at the bottom end 304 of panel 300.

Figure 4:
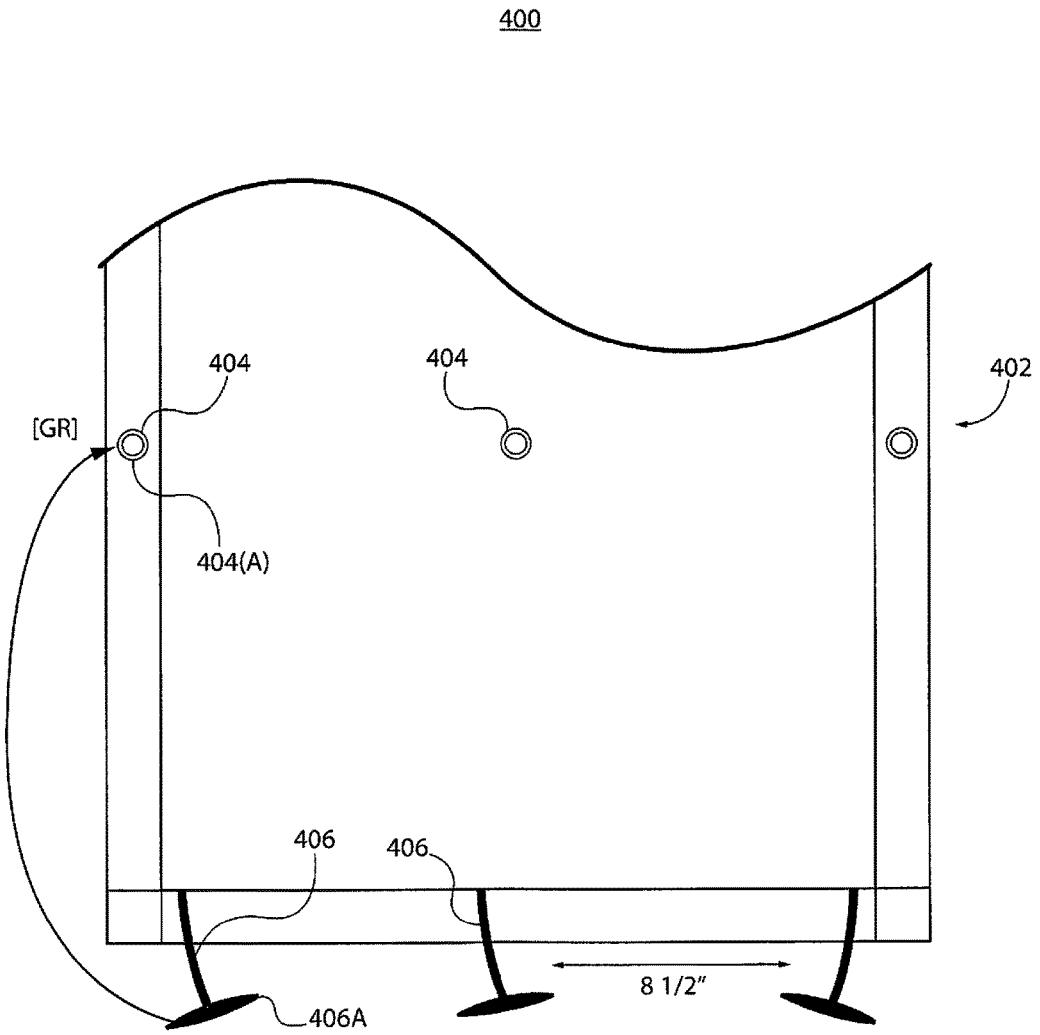
FIG. 4 shows a rear view of a panel adjustment system, according to one embodiment of the invention.

FIG. 4 shows a close-up view of an adjustment system 400 according to one embodiment of the invention. Adjustment system 400 comprises openings 404 (here shown as a row of three grommets—GR—arranged horizontally with one grommet positioned in the center of the panel 402, and a grommet positioned near each outer end along the length of panel 402 (designated GR—grommet row—in the figure) and securement means 406 (here shown as a row of toggles attached near the bottom end of panel 402, with a toggle positioned to align in closely with a corresponding opening). In one embodiment, a toggle (shown here as toggle 406A) is aligned with a grommet (shown here as 404A) as directed by the arrow, showing toggle 406A to be inserted in grommet 404(A) for adjustment of panel length. (FIG. 4 also shows that panel 402 need not have a grommet row at the bottom edge of the panel.)

Figure 5:
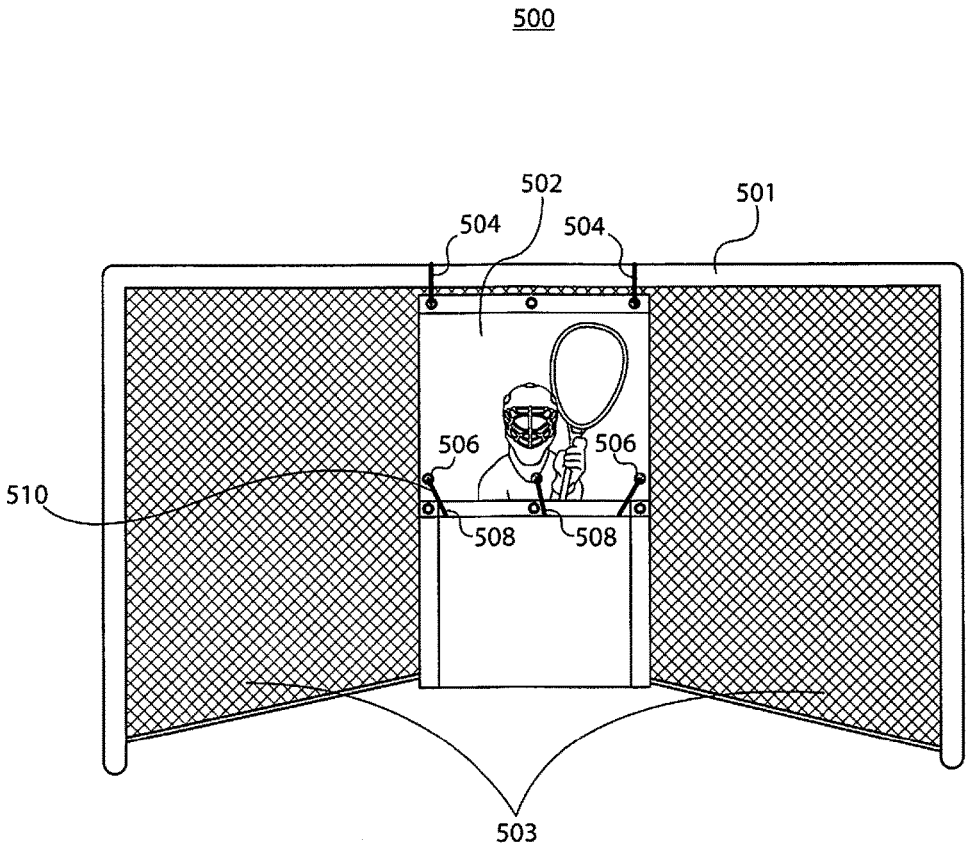
FIG. 5 shows a front view of a multi-sport training system comprising a single panel, whereby the panel is adjusted to expose the lower portion of the goal area, according to one embodiment of the present invention.

FIG. 5 shows a front view of a multi-sport training system 500 configured with a single panel 502 attached to a crossbar 501 of a goal 503 via attachment means 504, and shown adjusted in length by folding the panel 502 on itself and aligning toggles 508 with grommets (row of grommets) 506 (collectively, a panel adjustment system 510), thereby exposing the lower portion of the center of the goal area 503.

It will be clear to a person skilled in the art that features described in relation to any of the embodiments described above can be applicable interchangeably between the different embodiments. The embodiments described above are examples to illustrate various features of the invention.

Throughout the description and claims of this specification, the words "comprise" and "contain" and variations of them mean "including but not limited to", and they are not intended to (and do not) exclude other arrangements, configurations or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, embodiments or examples of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with this disclosure in connection with this application, and the contents of all such papers and documents are incorporated herein by reference.

The invention claimed is:

1. A multi-sport training system, comprising:

a frame comprising a horizontal crossbar coupled to a pair of upright side members aligned perpendicular to the crossbar to create an open goal area;

a plurality of flexible panels having a plurality of attachment members configured for reversible attachment of each panel of the plurality of flexible panels to the crossbar, wherein the attachment members allow each panel to hang vertically from and rotate 360 degrees around the crossbar;

wherein each of the plurality of flexible panels include an adjustment means comprising horizontal rows of openings and vertical columns of openings;

a plurality of mating securement features affixed along a bottom of each of the plurality of flexible panels in alignment with the openings;

wherein each of the plurality of mating securement features is removably received within a selected horizontal row of openings allowing each panel of the plurality of flexible panels to be folded upwardly and secured thereto.

2. The multi-sport training system of claim 1, wherein each of the plurality of flexible panels is 70 to 72 inches in length and 22 to 25 inches in width.

3. The multi-sport training system of claim 1, wherein each of the plurality of flexible panels includes a weighting means capable of temporary attachment to the bottom of each panel and wherein the weight of the weighting means is 2 ounces to 2 pounds.

4. The multi-sport training system of claim 1, wherein the crossbar ranges in length from 4 feet to 7 feet, and the pair of upright side members range in length from 4 feet to 7 feet.

5. The multi-sport training system of claim 1, each of the plurality of flexible panels further comprises at least one image affixed thereto.

6. The multi-sport training system of claim 1, wherein the plurality of openings include a plurality of grommets for removably receiving the plurality of mating securement features, and wherein the plurality of mating securement features consists of a plurality of toggles.

7. The multi-sport training device of claim 1, wherein the attachment members are selected from the group consisting of bungee cords, ropes, clips, elastic bands, hook-and-loop fasteners, snaps, strings, rubber hands, toggles, grommets, clips and combinations thereof.

8. The multi-sport, training device of claim 1, wherein the plurality of attachment members comprises a horizontal row of three grommets located at a top end of each of the plurality of flexible panels.

9. The device of claim 1, further comprising a net attached to the horizontal crossbar and the pair of upright side members to span the open goal area and create a backstop for objects shot into the open goal area.

* * * * *